US005287124A

United States Patent [19]

Fukahori

[11] Patent Number: 5,287,124

[45] Date of Patent: Feb. 15, 1994

[54] COLOR VIDEO PRINTER HAVING A MULTICOLOR PRINTING MODE AND A MONOCHROMATIC PRINTING MODE

[75] Inventor: Kenichi Fukahori, Kanagawa, Japan

[73] Assignee: Sony Corporation, Tokyo, Japan

[21] Appl. No.: 959,049

[22] Filed: Oct. 9, 1992

[30] Foreign Application Priority Data

Oct. 23, 1991 [JP] Japan ..... 3-274386

[51] Int. Cl.[5] ..... B41J 2/32

[52] U.S. Cl. ..... 346/76 PH; 400/120

[58] Field of Search ..... 346/76 PH; 400/120

[56] References Cited

U.S. PATENT DOCUMENTS 4,949,097 8/1990 Imaseki ..... 346/76 PH 5,144,331 9/1992 Amano ..... 346/76 PH

FOREIGN PATENT DOCUMENTS 0212969 12/1983 Japan ..... 400/120

0213172 9/1986 Japan ..... 400/120

*Primary Examiner*—Benjamin R. Fuller

*Assistant Examiner*—Huan Tran

*Attorney, Agent, or Firm*—Philip M. Shaw, Jr.

[57] ABSTRACT

A color video printing apparatus includes a first sensor detecting a recording medium and determining whether the recording medium is a thermalsensible one, and a second sensor detecting a color ink ribbon cartridge which accommodates a color ink ribbon therein. The apparatus also includes a system controller which controls driving operations of a thermal head and the color ink ribbon depending upon detection results obtained by the first and second sensors, so that a video image is printed on the recording medium in multicolor or monochromatic printing mode.

6 Claims, 3 Drawing Sheets

COLOR VIDEO PRINTER HAVING A MULTICOLOR PRINTING MODE AND A MONOCHROMATIC PRINTING MODE

BACKGROUND OF THE INVENTION

The present invention relates to a color video printing apparatus, and particularly to a video printing apparatus capable of selectively performing printing of a video image in multicolor or monochromatic printing mode depending upon a sort of a recording medium.

Color video printers for printing a video image in multicolor on a sheet are well known in the art. Many color video printers include a thermal head for printing the video image, for instance, on a sheet of thermal-transfer type by means of a color ink ribbon. The color ink ribbon includes a substrate film and heat-sublimatable color layer formed on the substrate film. The color layer has a plurality of color blocks arranged in series in spaced relation to each other. Each of the color blocks comprises segments arranged in a predetermined order, for example, yellow, magenta and cyan colors. The segments are in turn printed on the sheet of thermal-transfer type to form a multicolor image thereon.

The monochromatic printing may be performed by transferring the three segments of the color block on the sheet in the predetermined sequence. However, the time required for the monochromatic printing by using the color ink ribbon is longer than that for the monochromatic printing on a sheet of thermalsensible type without using the color ink ribbon. In addition, the sheet of thermal-transfer type is more expensive than that of thermalsensible type.

There is a demand to provide a color video printer capable of selectively performing a monochromatic printing on a sheet of thermalsensible type without using a color ink ribbon in addition to a multicolor printing on a sheet of thermal-transfer type by using the color ink ribbon.

An object of the present invention is to provide a color video printing apparatus capable of shifting from a multicolor printing mode to a monochromatic printing mode and vice versa.

SUMMARY OF THE INVENTION

According to the present invention, there is provided a color video printing apparatus for printing a video image on a recording medium in one of multicolor and monochromatic printing modes, comprising:

a platen;

a thermal head disposed in opposed relation to the platen, the recording medium being delivered from a supply source to a space between the platen and the thermal head;

a first sensor for detecting the recording medium in the supply source and determining whether the recording medium is a thermalsensible one;

a second sensor detecting a color ink ribbon to be guided through the space, the color ink ribbon having a substrate and a plurality of color blocks formed on the substrate and spaced from each other by blank blocks;

means for driving the color ink ribbon relative to the thermal head; and means for controlling the thermal head and the ink ribbon driving means depending upon detection results by the first and second sensors;

wherein the controlling means energizes the thermal head to print the video image on the recording medium when the first sensor detects the recording medium being a thermalsensible recording medium and the second sensor does not detect the color ink ribbon, while the controlling means causes the driving means to drive the color ink ribbon so as to locate one of the blank blocks in a position opposed to the thermal head and thereafter the controlling means energizes the thermal head to print the video image on the recording medium when the first sensor detects the recording medium being a thermalsensible recording medium and the second sensor detects the color ink ribbon.

DESCRIPTION OF THE PREFERRED EMBODIMENT

Figure 1:
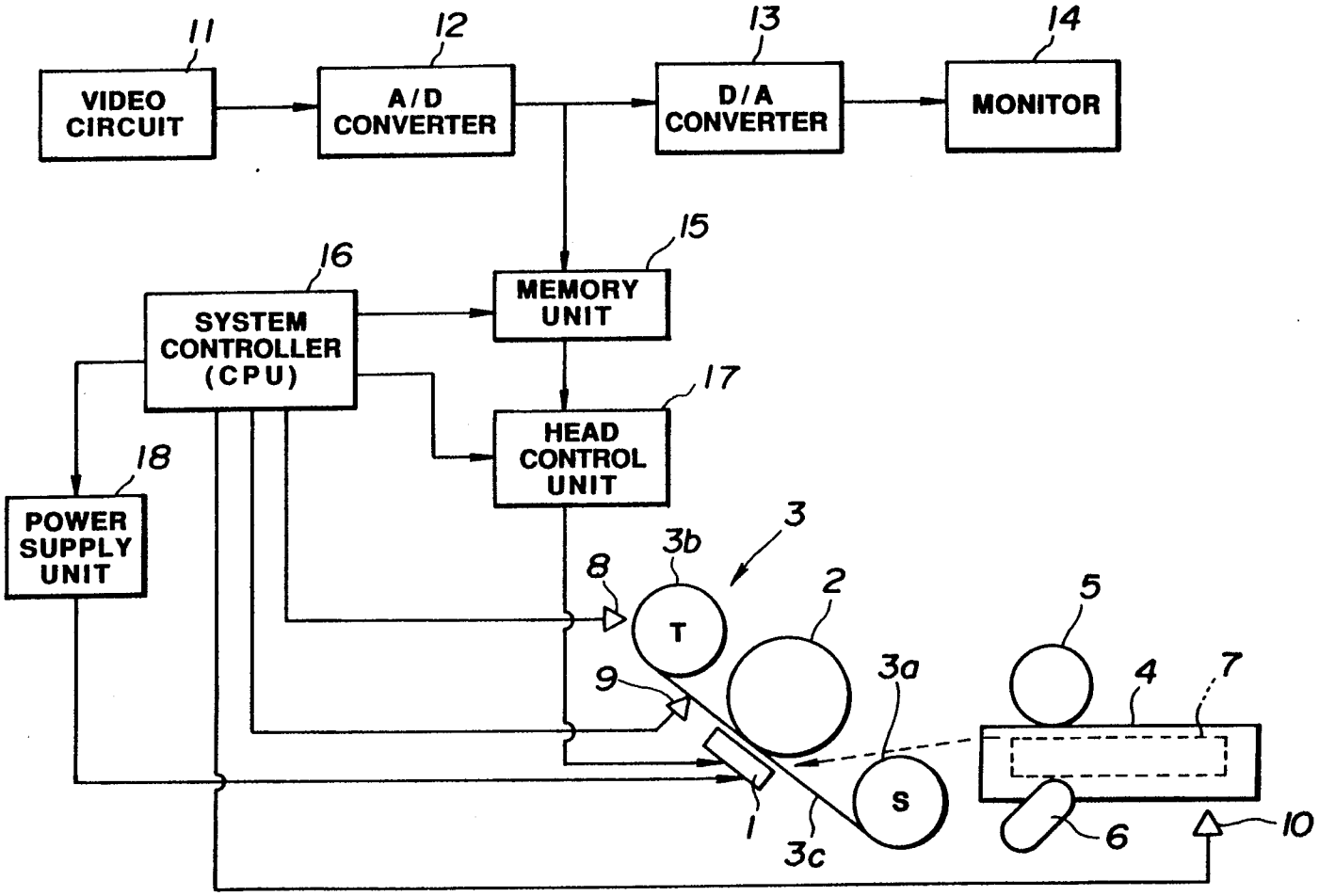
FIG. 1 is a block diagram of a preferred embodiment of a color video printing apparatus according to the present invention.

Referring now to FIG. 1, there is shown a block diagram of a preferred embodiment of a color video printing apparatus according to the present invention. As shown in FIG. 1, the color video printing apparatus includes a housing (not shown) which accommodates a thermal head 1 and a platen roller 2 opposed to the thermal head 1. Through a space between the thermal head 1 and the platen roller 2 is guided a color ink ribbon 3*c* derived from an ink ribbon cartridge 3. The ink ribbon cartridge 3 is detachably mounted in the housing and includes supply (S) and take-up (T) reels 3*a* and 3*b* to which the color ink ribbon 3*c* is connected at its ends. The color ink ribbon 3*c* is transported from the supply reel 3*a* to the take-up reel 3*b* via a capstan roller and a pinch roller (neither shown).

Figure 2:
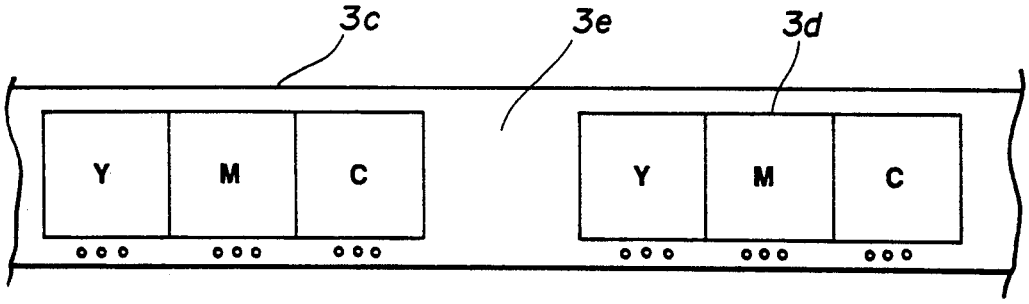
FIG. 2 is a schematic fragmentary view of a color ink ribbon, showing two color blocks and a blank block therebetween.

Between the platen roller 2 and the color ink ribbon 3*c* is delivered a sheet 7 which is stored in a sheet holder 4. The sheet 7 is lifted by a sheet lifter arm 6 to be urged against a sheet feed roller 5 which is rotatably disposed over the sheet holder 4. The sheet 7 is fed onto the platen roller 2 by rotation of the sheet feed roller 5. The color ink ribbon 3*c* is urged against the sheet 7 between the platen roller 2 and the thermal head 1. The color ink ribbon 3*c* includes a substrate film and a plurality of color blocks 3*d* formed on the substrate film as seen in FIG. 2. The adjacent two color blocks 3*d* are spaced from each other by a blank block 3*e*. Each of the color blocks 3*d* comprises segments, for example, yellow (Y), magenta (M) and cyan (C) colors, and is used for printing of each sheet 7. When the color block 3*d* of the color ink ribbon 3*c* is urged against the sheet 7 by the thermal head 1, the three segments are in turn printed thereon in a given sequence to form a multicolor image. Thus, three times of the printing operation serves for printing the multicolor image on each sheet 7.

As shown in FIG. 1, an ink ribbon cartridge sensor 8 is disposed adjacent the ink ribbon cartridge 3 to detect whether the ink ribbon cartridge 3 is mounted. A color sensor 9 is disposed adjacent the thermal head 1 to detect colors of the segments of the color block 3*d* on the color ink ribbon 3*c*. The detection of colors is performed by detecting a mark recorded on a side blank portion which is disposed on an outer periphery of the color block 3*d* as seen in FIG. 2. The color sensor 9 also detects the blank block 3*e* disposed between the adjacent two color blocks 3*d* which are used in the printing operation. A sheet identification sensor 10 is disposed adjacent the sheet holder 4 to detect setting of the sheet 7 and identify whether the sheet 7 is of thermal-transfer type or thermalsensible type. The identification of the sheet 7 is performed by detecting a mark which is recorded on a peripheral space of the sheet 7 in the form such as a bit pattern.

As shown in FIG. 1, the thermal head 1 is connected to a head control unit 17 which is designed for driving the thermal head 1 and a power supply unit 18 which is designed for controlling an electric voltage applied to the thermal head upon printing. The head control unit 17 and the power supply unit 18 are connected to a system controller (CPU) 16. The ink ribbon cartridge sensor 8, the color sensor 9 and the sheet identification sensor 10 also are connected to the system controller (CPU) 16. Respective results of detection by the sensors 8, 9 and 10 are transmitted to the system controller (CPU) 16. The system controller (CPU) 16 is designed for shifting a multicolor printing mode to a monochromatic printing mode and vice versa depending upon the detection results by means of the sheet identification sensor 10.

A memory unit 15 is connected to the system controller (CPU) 16 and further connected via an A/D converter 12 with a video circuit 11. The video circuit 11 receives a video signal and transmits an analog signal to the A/D converter 12. The analog signal is converted into a digital signal in the A/D converter 12 to be transmitted to the memory unit 15. The memory unit 15 stores the digital signal under control of the system controller (CPU) 16. The digital signal converted in the A/D converter 12 is also transmitted to a D/A converter 13. The D/A converter 13 converts the digital signal into an analog signal which is transmitted to a monitor 14. As seen in FIG. 1, the memory unit 15 also is connected to the head control unit 17. Color information stored in the memory unit 15 is transmitted to the head control unit 17 for multicolor printing. The head control unit 17 receives a drive control signal for driving the thermal head 1 from the system controller (CPU) 16. The power supply unit 18 receives, from the system controller (CPU) 16, a voltage control signal for optimally controlling the electric voltage applied to the thermal head 1. The optimal voltage is determined depending upon the detection results by the ink ribbon cartridge sensor 8 and the sheet identification sensor 10.

Figure 3:
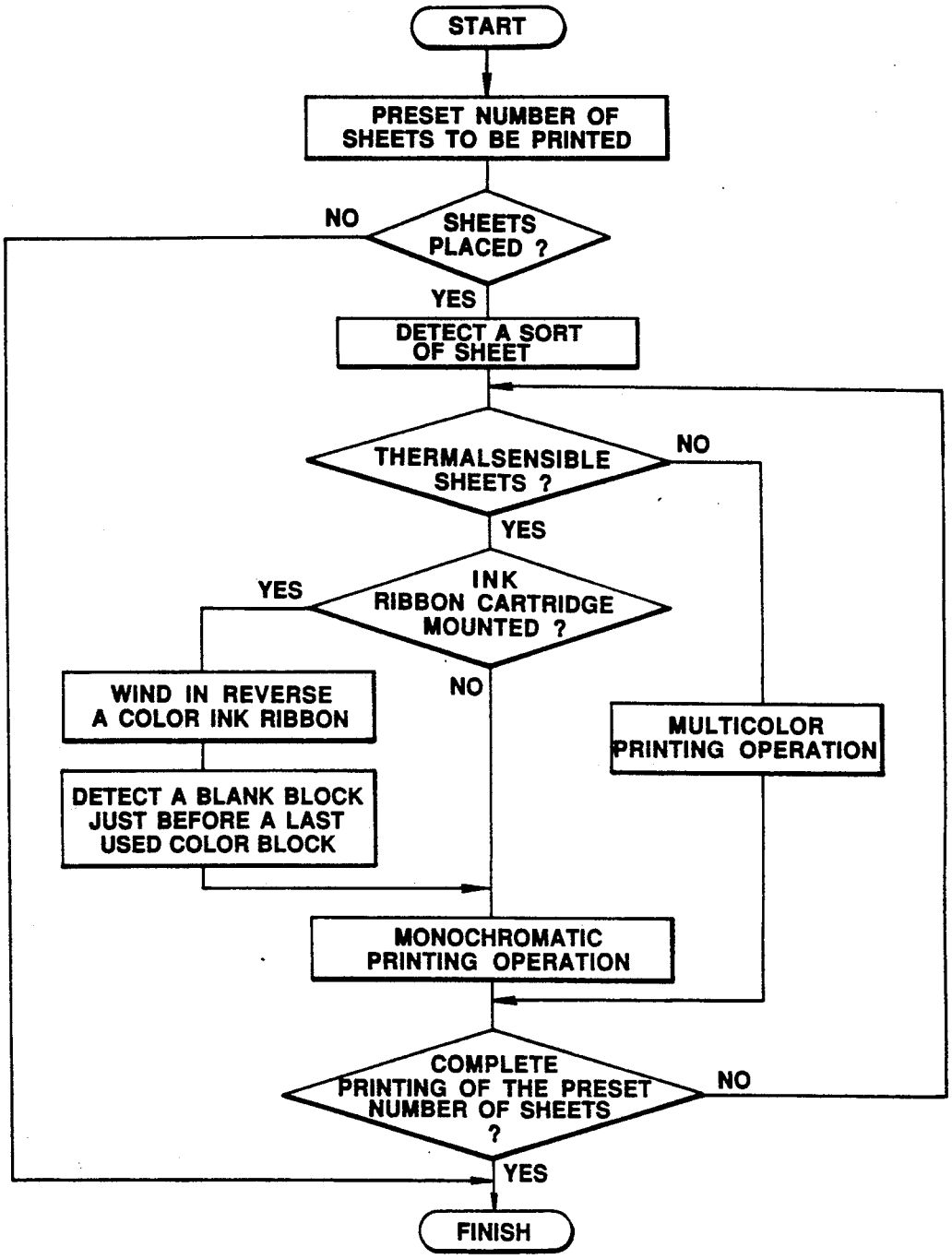
FIG. 3 is a flow chart showing processing steps in printing operation of the color video printing apparatus of FIG. 1.

Referring to FIG. 3, there is shown a flow chart which indicates processing steps of the color video printing apparatus according to the present invention. As shown in FIG. 3, the number of sheets 7 to be printed is preset subsequent to power-on of the color video printing apparatus. The sheet identification sensor 10 detects whether or not the sheets 7 are held in the sheet holder 4. If no sheet is detected, subsequent processing steps of the apparatus are cancelled. In a case where the sheets 7 are detected, the sheet identification sensor 10 further detects whether or not the sheets 7 are of thermalsensible type. If the thermalsensible sheets 7 are detected, the system controller (CPU) 16 selects the monochromatic printing mode.

In the monochromatic printing mode, the ink ribbon cartridge sensor 8 detects whether the ink ribbon cartridge 3 is mounted in the housing of the apparatus. If the mounted ink ribbon cartridge 3 is detected, the color ink ribbon 3*c* is wound in a reverse direction until the color sensor 9 detects the blank block 3*e* just before the last used color block 3*d* on the color ink ribbon 3*c*. Subsequently, the thermal head 1 is urged against the sheet 7 through the blank block 3*e* so that a monochromatic image is printed on the thermalsensible sheet 7. Without the ink ribbon cartridge 3, the monochromatic printing operation is directly performed without the reverse winding of the color ink ribbon 3*c*. Such a monochromatic printing operation is repeated until printing of the preset number of sheets 7 is completed.

In a case where the sheets 7 of non-thermalsensible type, for example, thermal-transfer type, are detected, the system controller (CPU) 16 selects the multicolor printing mode. In the multicolor printing mode, the thermal head 1 is three times urged against the sheet 7 per one color block 3*d* of the color ink ribbon 3*c*. That is, the three segments including yellow, magenta and cyan colors are in turn printed on the sheet 7 so as to form a multicolor image thereon. The multicolor printing operation is repeated until printing of the present number of sheets 7 is completed.

As is appreciated from the above description, the monochromatic printing operation in the apparatus according to the present invention requires a shorter time than the multicolor printing operation because the monochromatic printing is finished in only one time operation of the thermal head 1.

The sheet 7 of thermalsensible type may be in the form of a roll so that the sheet 7 is increased in size in a longitudinal direction. In addition, the electric voltage applied to the thermal head 1 may be controlled in such a manner as pulse modulation by the head control unit 17.

What is claimed is:

1. A color video printing apparatus for printing a video image on a recording medium in one of multicolor and monochromatic printing modes, comprising:

a platen;

a thermal head disposed in opposed relation to said platen, said recording medium being delivered from a supply source to a space between said platen and said thermal head;

a first sensor for detecting said recording medium in said supply source and determining whether said recording medium is a thermalsensible one;

a second sensor detecting a color ink ribbon to be guided through said space, said color ink ribbon having a substrate and a plurality of color blocks formed on the substrate and spaced from each other by blank blocks;

means for driving said color ink ribbon relative to said thermal head; and means for controlling said thermal head and said ink ribbon driving means depending upon detection results by said first and second sensors;

wherein said controlling means energizes said thermal head to print the video image on said recording medium when said first sensor detects said recording medium being a thermalsensible recording medium and said second sensor does not detect said color ink ribbon, while said controlling means causes said driving means to drive said color ink ribbon so as to locate one of said blank blocks in a position opposed to said thermal head and thereafter said controlling means energizes said thermal head to print the video image on said recording medium when said first sensor detects said recording medium being a thermalsensible recording medium and said second sensor detects said color ink ribbon.

2. A color video printing apparatus as claimed in claim 1, further comprising a third sensor which detects a predetermined position of said color ink ribbon.

3. A color video printing apparatus as claimed in claim 1, wherein both of said printing modes are cancelled when said first sensor does not detect said recording medium.

4. A color video printing apparatus as claimed in claim 1, wherein said multicolor printing mode is performed using the color blocks of said color ink ribbon when said first sensor detects a non-thermalsensible recording medium.

5. A color video printing apparatus as claimed in claim 4, wherein said non-thermalsensible recording medium is of a thermal-transfer type.

6. A color video printing apparatus as claimed in claim 1, wherein said thermalsensible recording medium is in a form of a roll.

* * * * *